US007670211B2

(12) United States Patent
Nishiki

(10) Patent No.: US 7,670,211 B2
(45) Date of Patent: Mar. 2, 2010

(54) ROTATING POLISHING TOOL

(75) Inventor: Naomi Nishiki, Osaka (JP)

(73) Assignee: Taiyo Shokai Co., Ltd., Osaka (JP)

( * ) Notice: Subject to any disclaimer, the term of this patent is extended or adjusted under 35 U.S.C. 154(b) by 271 days.

(21) Appl. No.: 10/592,822

(22) PCT Filed: Jul. 5, 2004

(86) PCT No.: PCT/JP2004/009545

§ 371 (c)(1),
(2), (4) Date: Sep. 14, 2006

(87) PCT Pub. No.: WO2006/003712

PCT Pub. Date: Jan. 12, 2006

(65) Prior Publication Data

US 2008/0160884 A1 Jul. 3, 2008

(51) Int. Cl.
*B23F 21/03* (2006.01)

(52) U.S. Cl. ..... 451/544; 451/546

(58) Field of Classification Search ..... 451/194, 451/178, 540–551; 125/5
See application file for complete search history.

(56) References Cited

U.S. PATENT DOCUMENTS 3,742,655 A * 7/1973 Oliver ..... 451/488
5,038,448 A * 8/1991 Gusmer ..... 492/41
2002/0123302 A1 * 9/2002 Maras et al. ..... 451/542

FOREIGN PATENT DOCUMENTS

JP 50-75494 7/1975
JP 59175958 A * 10/1984
JP 2004-1145 1/2004

* cited by examiner

*Primary Examiner*—Dung Van Nguyen
(74) *Attorney, Agent, or Firm*—Wenderoth, Lind & Ponack, L.L.P.

(57) ABSTRACT

The present invention has an object to provide a rotating polishing tool with high durability that can finish a polished surface with desired surface roughness. As means thereof, a substantially cylindrical polishing member 3 is constituted by a pair of polishing units 9 at opposite ends, and an intermediate portion 10 provided between the pair of polishing units 9. The polishing member 3 is rotatably supported around the central axis thereof, and polishes a polished surface with a peripheral surface thereof. The polishing unit 9 includes a plurality of abrasive cloth/paper sheets 7 pressingly held by an inner metal fitting 8, and forms peripheral edges of the abrasive cloth/paper sheets 7 into a serpentine shape. The intermediate portion 10 includes a plurality of laminated abrasive cloth/paper sheets 7 axially pressingly held by the polishing units 9. The intermediate portion 10 is caused to fit along the polishing units 9 to form the peripheral edge of each abrasive cloth/paper sheet 7 into a serpentine shape. No clearance is created between the abrasive cloth/paper sheets 7, thereby stabilizing surface roughness of the polished surface and increasing durability of the polishing member 3.

4 Claims, 8 Drawing Sheets

(a)

(b)

ROTATING POLISHING TOOL

TECHNICAL FIELD

The present invention relates to a rotating polishing tool suitable for removing scales and flaws on, for example, a surface of a steel plate.

BACKGROUND ART

Generally, scales on a surface of a steel plate are removed by polishing the surface of the steel plate. The polishing of the surface is an important process for post-machining of a steel plate. For example, when a polished steel plate is bent to form a tank wall of an oil tank, a flaw on a surface of a supplied steel plate remaining on a polished surface may cause the steel plate to be broken by bending stress. Thus, the polishing of the surface needs to be finished without any flaw remaining on the polished surface. Generally, coating is applied on the polished surface to protect the surface, and the polished surface needs to have surface roughness suitable for coating.

As means for forming such a polished surface, a rotating polishing tool has been adopted in which a plurality of laminated disk-shaped abrasive cloth/paper sheets constitute a cylindrical polishing member, the polishing member is rotated around a central axis thereof to polish a polished surface with a peripheral surface of the polishing member, that is, a peripheral edge of each abrasive cloth/paper sheet.

When the polishing member including the plurality of flat abrasive cloth/paper sheets simply laminated is adopted, the polished surface is microscopically polished only by a peripheral edge of each abrasive cloth/paper sheet and not polished by portions between the abrasive cloth/paper sheets. Thus, the peripheral edge of each abrasive cloth/paper sheet comes into contact with the polished surface to produce a plurality of streak-like irregularities on a finished polished surface.

On the other hand, Patent Document 1 discloses a rotating polishing tool in which peripheral edges of abrasive cloth/paper sheets are formed into a serpentine shape to prevent production of streak-like irregularities, thereby finishing a polished surface with desired surface roughness.

FIG. 8 shows the rotating polishing tool disclosed in Patent Document 1. In the rotating polishing tool 12, a plurality of laminated abrasive cloth/paper sheets 7 are pressingly held by an inner metal fitting 8, the inner metal fitting 8 is bent to form a polishing unit 9 having a serpentine peripheral edge, and a plurality of polishing units 9 are laminated to constitute a cylindrical polishing member 11. While rotating the polishing member 11, this configuration allows the peripheral edges of the abrasive cloth/paper sheets 7 to move reciprocatively in the direction of a central axis to bring the peripheral edges of the abrasive cloth/paper sheets 7 into contact with the entire polished surface.

[Patent Document 1] Japanese Patent Laid-Open No. 2004-1145 (paragraphs 0006, 0015, and 0016, and FIG. 2)

DISCLOSURE OF THE INVENTION

The polishing member in Patent Document 1 has a structure in which the plurality of polishing units are laminated each including the plurality of abrasive cloth/paper sheets pressingly held by the inner metal fitting, and thus the inner metal fittings of the adjacent polishing units come into contact with each other to easily create a clearance having a thickness twice a thickness of a plate constituting an inner metal fitting, between the abrasive cloth/paper sheets of the adjacent polishing units.

The clearance between the abrasive cloth/paper sheets may cause an uneven distribution density of abrasive grains in the polishing member to cause variations in surface roughness of the polished surface, or reduce durability of the polishing member resulting from a reduction in the distribution density of the abrasive grains or clogging with the abrasive grains.

The present invention has an object to solve the above described problems and provide a rotating polishing tool with high durability that can finish a polished surface with desired surface roughness.

In order to achieve the above described object, the present invention provides a rotating polishing tool in which a substantially cylindrical polishing member is rotatably supported around a central axis thereof, and the polishing member is rotated to polish a subject to be polished with a peripheral surface thereof, wherein the polishing member includes a pair of polishing units at axial opposite ends of the central axis, and an intermediate portion including a plurality of laminated abrasive cloth/paper sheets and provided between the pair of polishing units.

The polishing unit includes a plurality of laminated substantially circular abrasive cloth/paper sheets each having a shaft insertion opening in the center, and the plurality of abrasive cloth/paper sheets are held and pressed by a ring-shaped inner metal fitting inserted through the shaft insertion openings. The inner metal fitting of the polishing unit is formed into a serpentine shape that curves in the axial direction of the central axis to form peripheral edges of the abrasive cloth/paper sheets into a serpentine shape.

The intermediate portion includes a plurality of abrasive cloth/paper sheets different from the abrasive cloth/paper sheets constituting the polishing unit, laminated along the central axis. The intermediate portion is pressingly held along the central axis by the pair of polishing units, and thus each abrasive cloth/paper sheet fits along the polishing units, and the peripheral edge of each abrasive cloth/paper sheet is formed into a serpentine shape.

According to this configuration, the intermediate portion includes no inner metal fitting, and only one plate is required that constitutes the inner metal fitting and is placed between the abrasive cloth/paper sheets in a boundary between the polishing unit and the intermediate portion, and thus the abrasive cloth/paper sheets can be laminated without any clearance. This allows an even distribution density of abrasive grains in the polishing member to the utmost to stabilize surface roughness of the polished surface, increases the distribution density of the abrasive grains, and prevents clogging with the abrasive grains, thereby increasing durability of the polishing member.

Further, the peripheral edges of the abrasive cloth/paper sheets are formed into a serpentine shape, and thus a developed shape thereof is a substantially S-shaped curve to bring the peripheral edges of the abrasive cloth/paper sheets into contact with the entire polished surface. This allows portions between the abrasive cloth/paper sheets to be polished to finish the polished surface with desired surface roughness.

Flanges are placed on opposite outer sides of the polishing unit along the central axis, and the polishing member is pressingly held by the flanges along the central axis. Inner side surfaces of the flanges along the central axis are formed into a serpentine shape corresponding to the serpentine shape of the inner metal fitting of the polishing unit to prevent the serpentine shape of the inner metal fitting of the polishing unit from being deformed when the polishing member is pressingly held, thereby allowing the polishing member to be firmly held and pressed and making it difficult to create a clearance between the abrasive cloth/paper sheets.

As methods for forming the peripheral edges of the abrasive cloth/paper sheets of the intermediate portion and the polishing unit into a serpentine shape, various methods may be adopted. For example, for the intermediate portion, the abrasive cloth/paper sheets may be previously shaped to some extent before pressingly held by the polishing units, or laminated flat abrasive cloth/paper sheets may be held and pressed by the polishing units and shaped so as to fit along the polishing units.

For the polishing unit, the abrasive cloth/paper sheets previously formed into a serpentine shape may be held by an inner metal fitting previously formed into a serpentine shape, or the inner metal fitting may be partially pressed along the central axis with a plurality of abrasive cloth/paper sheets being pressingly held, and thus bent into a serpentine shape that curves up and down in the axial direction of the central axis. This allows the peripheral edges of the flat abrasive cloth/paper sheets held by the inner metal fitting to be formed into a serpentine shape.

As the abrasive cloth/paper sheet, various base materials such as paper, cloth, or nonwoven fabric and abrasive grains of various grain sizes and materials may be used. If a mesh sheet is used as a base material and coated with abrasive grains, an increased amount of abrasive grains may adhere to the base material (mesh sheet), thereby reducing a pressurizing force during polishing.

As described above, according to the present invention, the polishing member has the intermediate portion including the plurality of laminated abrasive cloth/paper sheets and provided between the pair of polishing units, and thus no clearance is created between the abrasive cloth/paper sheets by the inner metal fitting unlike the structure including laminated polishing units. This improves an appearance of the product, allows an even distribution density of the abrasive grains to the utmost, allows the polished surface to be finished with desired surface roughness, increases the distribution density of the abrasive grains, and prevents clogging with the abrasive grains, thereby increasing durability of the polishing member.

DESCRIPTION OF SYMBOLS

Figure 1:
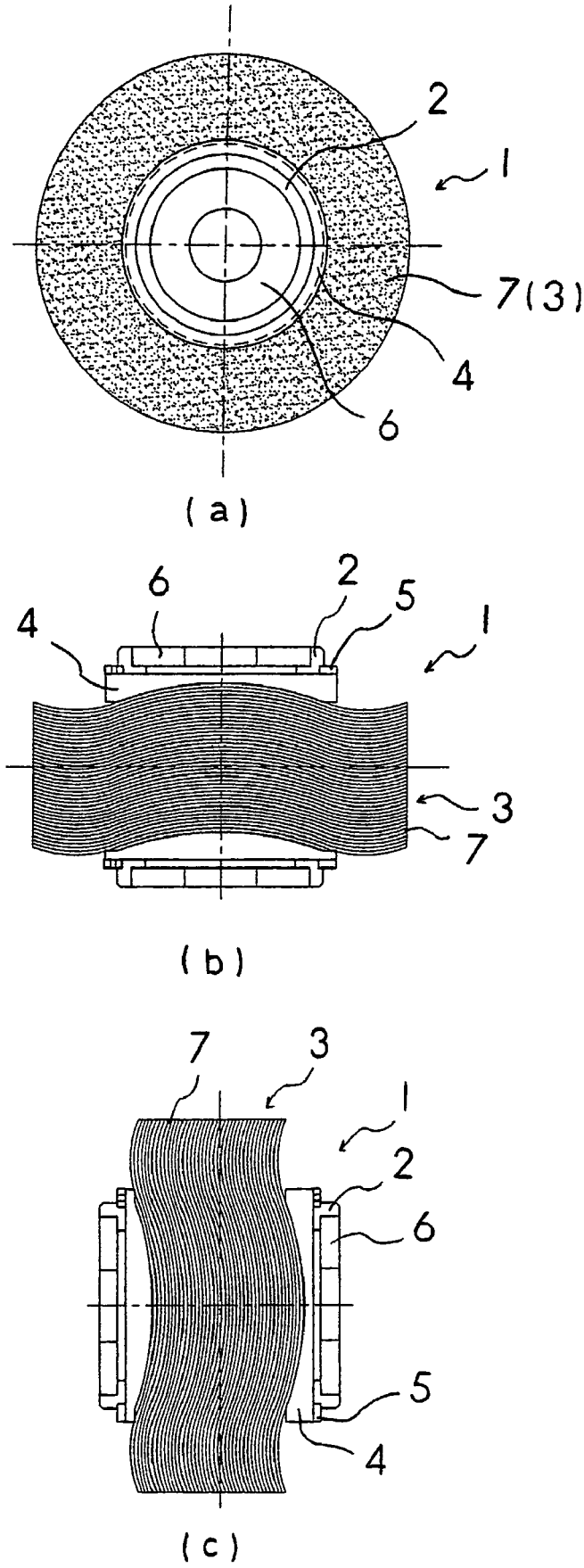
FIG. 1(*a*) is a front view of a rotating polishing tool according to the present invention, FIG. 1(*b*) is a plane view thereof, and FIG. 1(*c*) is a side view thereof.

1 rotating polishing tool
2 wheel shaft
3 polishing member
4 flange
5 snap ring
6 support plate
7 abrasive cloth/paper sheet
7*a* opening
8 inner metal fitting
8*a* cylindrical portion
8*b* flange portion
9 polishing unit
10 intermediate portion
11 polishing member (conventional example)
12 rotating polishing tool (conventional example)

BEST MODE FOR CARRYING OUT THE INVENTION

Now, a best mode for carrying out the invention will be described with reference to the drawings.

Figure 2:
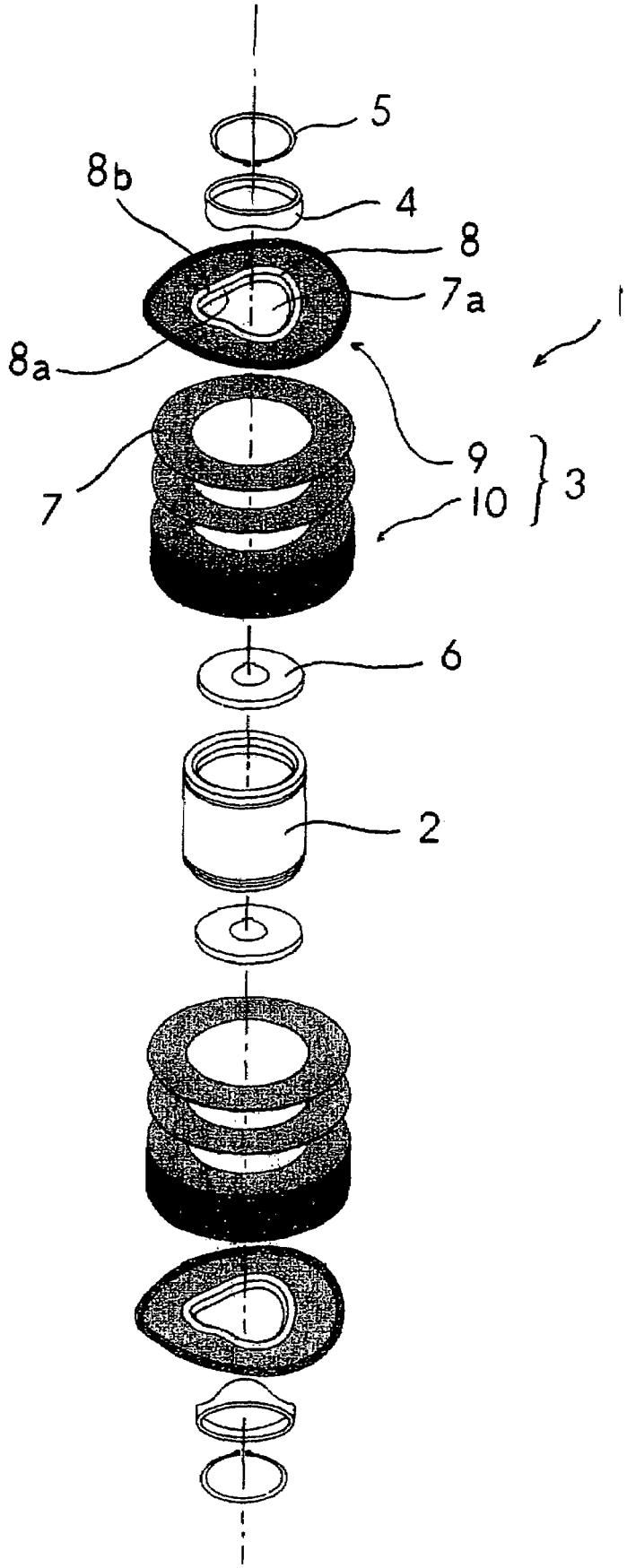
FIG. 2 is an exploded perspective view of the rotating polishing tool.

As shown in FIGS. 1 and 2, a rotating polishing tool 1 of the embodiment includes a wheel shaft 2 through which a rotating shaft driven by a drive source can be inserted, a substantially cylindrical polishing member 3 held on an outer periphery of the wheel shaft 2, and a pair of ring-shaped flanges 4 secured to opposite ends of the wheel shaft 2 so as to axially hold the polishing member 3.

The wheel shaft 2 is formed of, for example, steel into a cylindrical shape, and circumferentially continuous grooves in which C-shaped snap rings 5 are embedded to prevent the flanges 4 from being dislodged are formed in outer peripheral surfaces at opposite ends of the wheel shaft 2. Disk-shaped support plates 6 formed with bearings through which the rotating shaft passes are fitted on inner peripheries at the opposite ends of the wheel shaft 2.

The polishing member 3 includes a plurality of abrasive cloth/paper sheets 7 axially arranged, and is constituted by a pair of polishing units 9 provided at axial opposite ends, and an intermediate portion 10 provided between the pair of polishing units 9.

The abrasive cloth/paper sheet 7 includes a base sheet such as paper, cloth, or net having a surface coated with abrasive grains such as alumina or silicon carbide, and abrasive cloth/paper sheets produced by Riken Corundum Co. Ltd. or Sankyo Rikagagu Co. Ltd. are examples thereof. The abrasive cloth/paper sheet 7 is formed into a ring shape having an opening (shaft insertion opening) 7*a* in the center so as to fit the wheel shaft 2.

Figure 3:
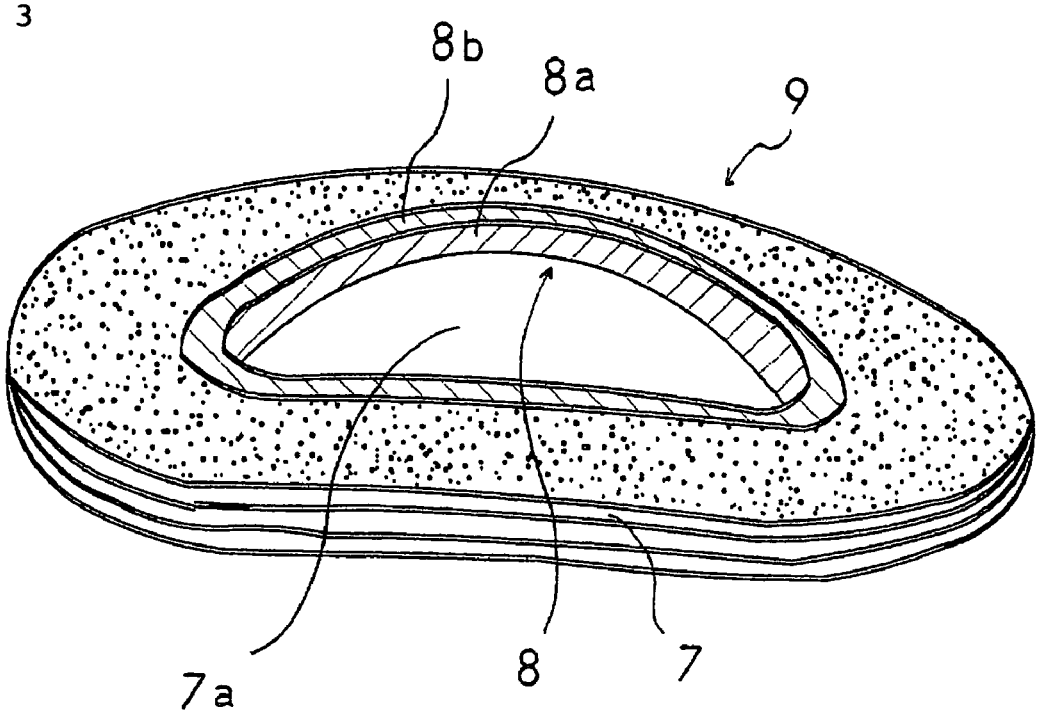
FIG. 3(*a*) is a perspective view of a polishing unit, and FIG. 3(*b*) is a side view thereof.
Figure 3:
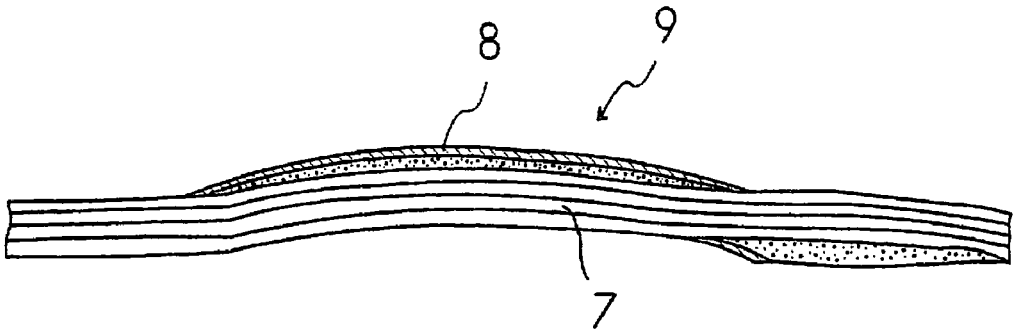
Figure 4:
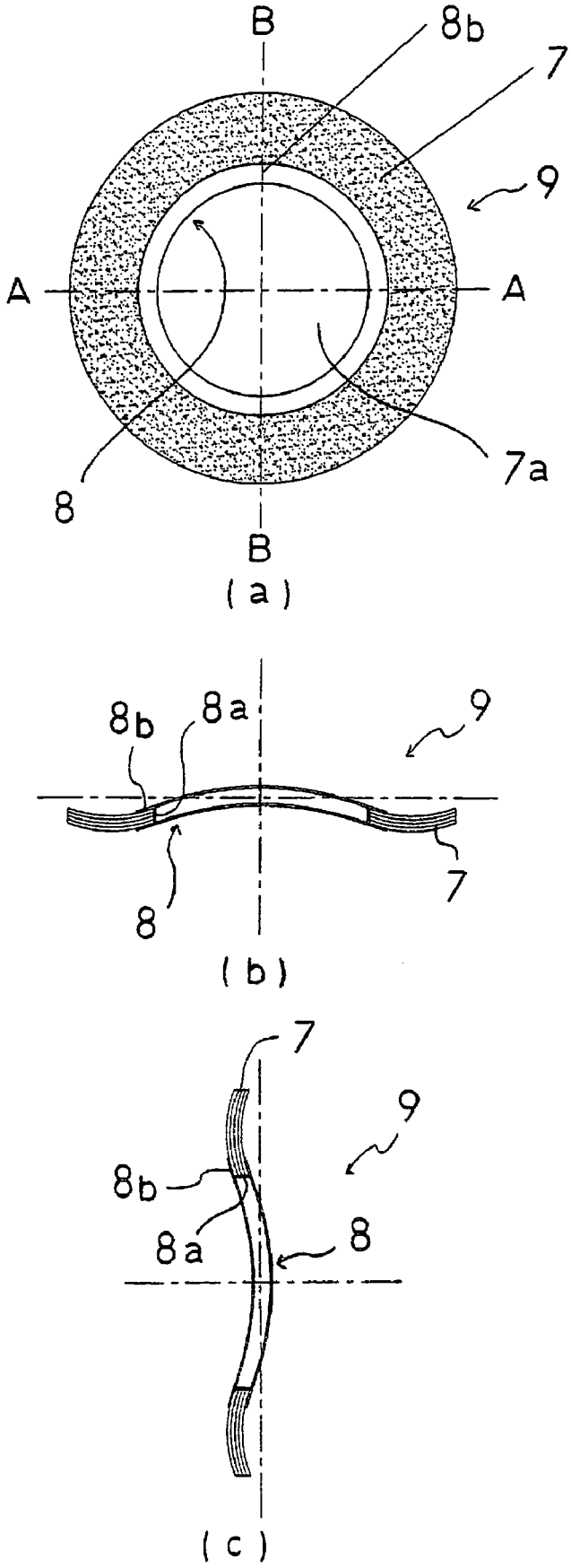
FIG. 4(*a*) is a front view of the polishing unit, FIG. 4(*b*) is a sectional view thereof taken along the line A-A, and FIG. 4(*c*) is a sectional view thereof taken along the line B-B.

The polishing unit 9 includes a plurality of laminated abrasive cloth/paper sheets 7, and holds and presses the abrasive cloth/paper sheets 7 with a ring-shaped inner metal fitting 8 inserted through openings 7*a*. As shown in FIGS. 3 and 4, the inner metal fitting 8 is constituted by a cylindrical portion 8*a* fitted over the wheel shaft 2, and a flange portion 8*b* that is bent to axial opposite sides and axially retains peripheral edges of the openings 7*a* of the abrasive cloth/paper sheets 7. The inner metal fitting 8 is partially pressed by upper and lower dies and bent into a serpentine shape that curves up and down in the axial direction, and thus the peripheral edges of the abrasive cloth/paper sheets 7 of the polishing unit 9 are formed into a serpentine shape.

The intermediate portion 10 includes the plurality of abrasive cloth/paper sheets 7 axially laminated, and is axially held and pressed by the pair of polishing units 9 to fit along the shape of the polishing unit 9, and thus the peripheral edge of each abrasive cloth/paper sheet 7 constituting the intermediate portion 10 is formed into a serpentine shape.

The flanges 4 are placed on axially opposite outer sides of the polishing unit 9 to hold and press the polishing member 3, and axial inner side surfaces are formed into a serpentine shape corresponding to the serpentine shape of the inner metal fitting 8.

Figure 5:
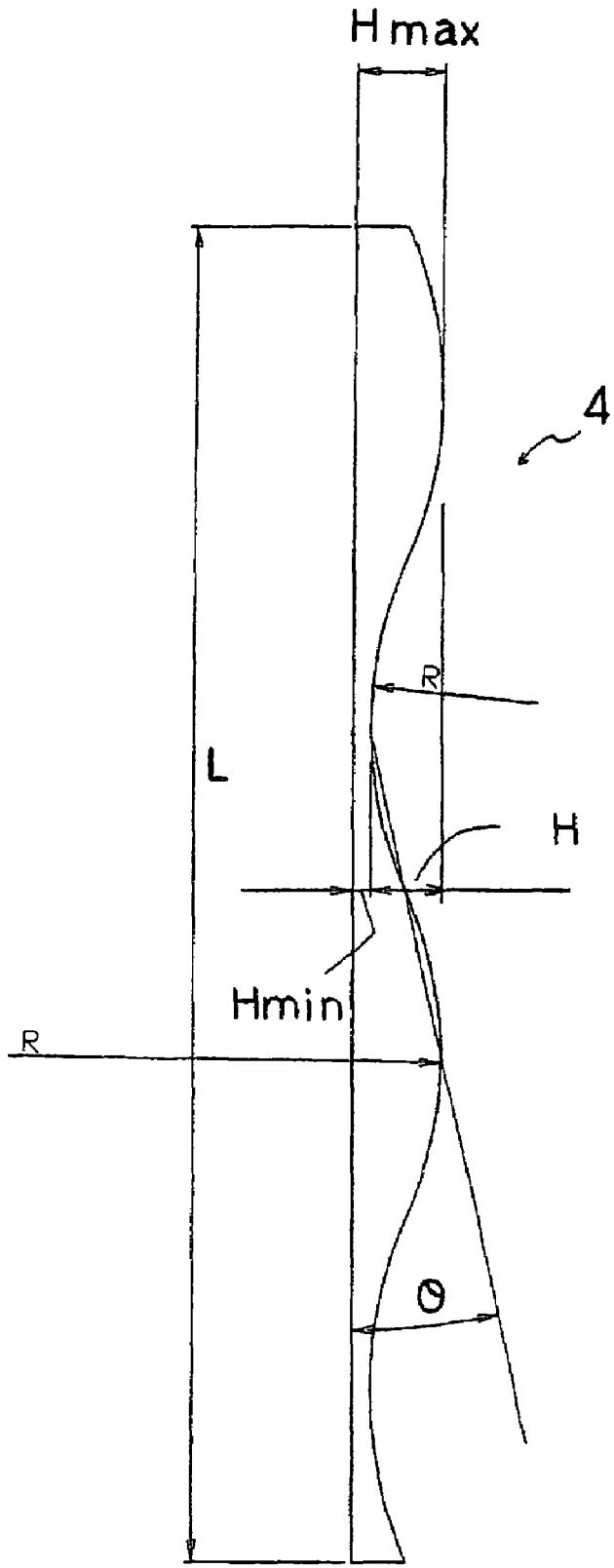
FIG. 5 is a developed view of an outer peripheral surface of a flange.

As shown in FIG. 5, the inner side surfaces in the axial direction of the flanges 4 have S-shaped curves having a combination of curved lines and a desired axial amplitude. The S-shaped curve in the embodiment is a gentle curve having a cycle of 180° and an amplitude ($\Delta H = Hmax - Hmin$) of 7 mm to 20 mm, and when the peripheral length (L) is 373.66 mm, an average gradient ($\theta$) between tops of the curve is 4° to 12°, and a radius of the curve (R) is 114.08 mm to 313.41 mm. These values are set so that the polishing member 3 is axially held and pressed along the curve to form the outer edge of each abrasive cloth/paper sheet 7 into a serpentine shape.

Figure 6:
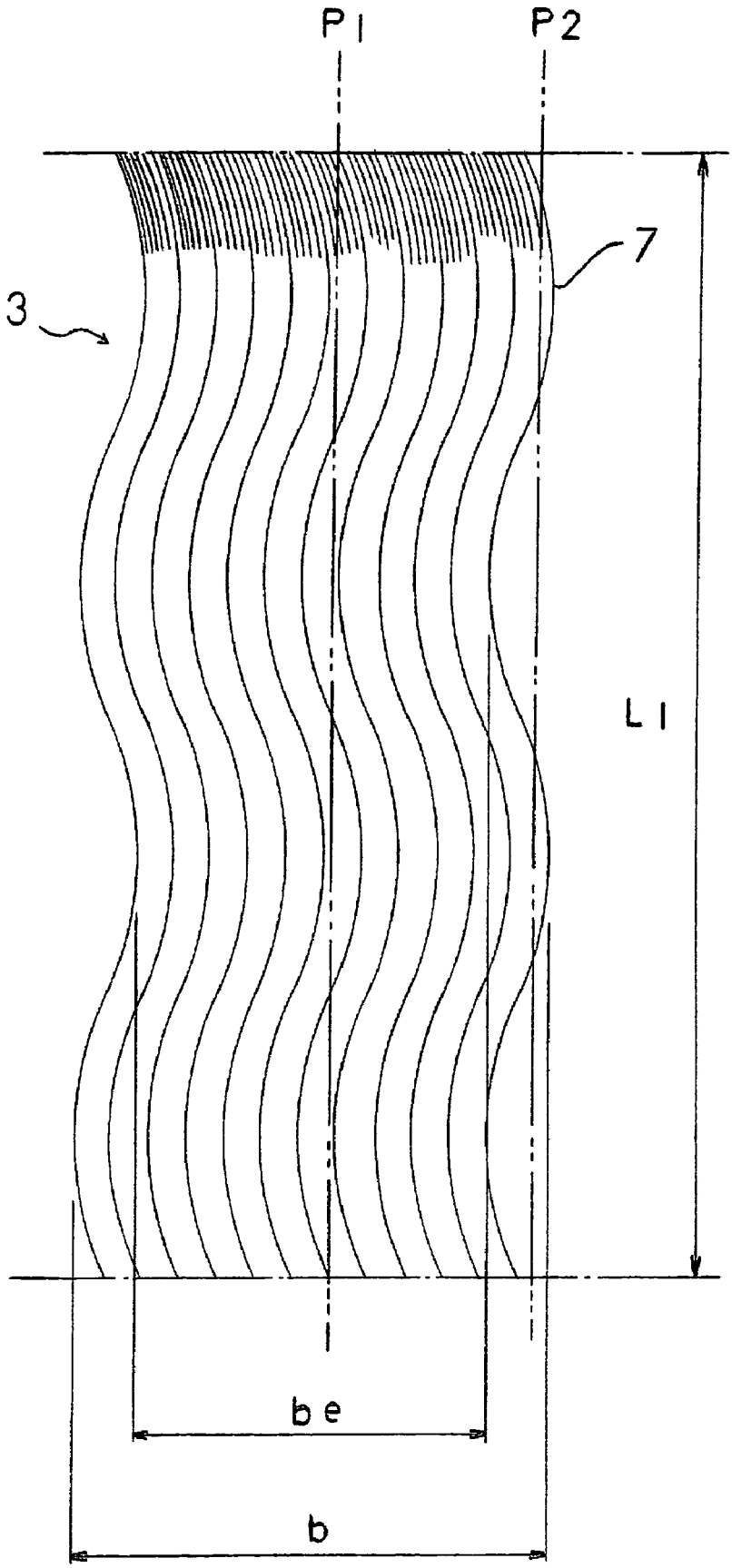
FIG. 6 is a developed view of an outer peripheral surface of a polishing member.

As shown in FIG. 6, in the outer peripheral surface of the polishing member 3, the outer edge of each abrasive cloth/paper sheet 7 has an S-shaped curve, the length between tops at axial outer ends is a polishing width (b), and the length between tops at axial inner sides is an effective polishing width (be). Specifically, the effective polishing width (be) is a width of a portion where the abrasive cloth/paper sheets 7 continuously come into contact with the polished surface.

Figure 7:
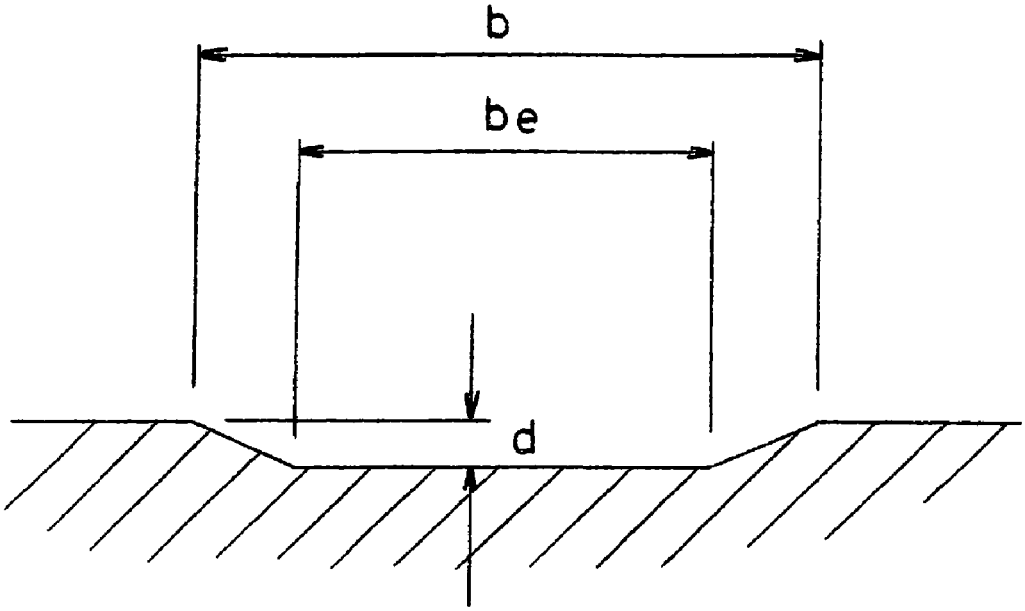
FIG. 7 shows a sectional shape of a polished surface.
Figure 8:
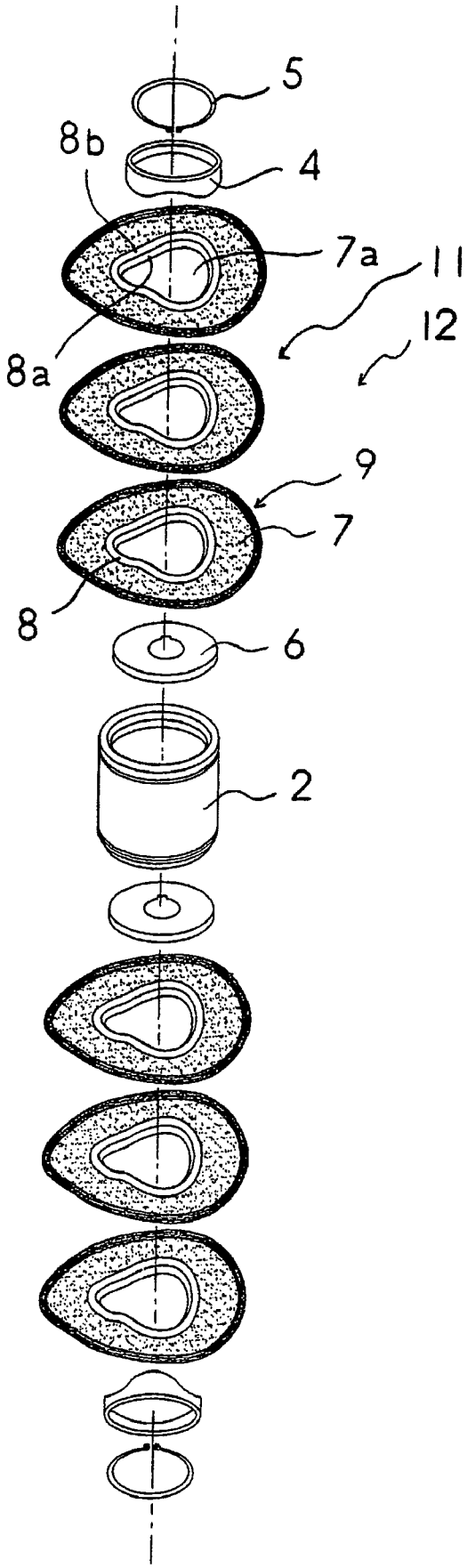
FIG. 8 is an exploded perspective view of a conventional rotating polishing tool.

Specifically, with a position P1 within a range of the effective polishing width (be) in the polishing width (b), an outer edge of each abrasive cloth/paper sheet 7 comes into contact, and then an outer edge of an adjacent abrasive cloth/paper sheet 7 successively comes into contact, and thus the polished surface is polished to a predetermined polishing depth (d). With a position P2 outside the range of the effective polishing width (be), outer edges of the abrasive cloth/paper sheets 7 at opposite axial ends come into contact, and then no outer edge of the abrasive cloth/paper sheet 7 comes into contact until the abrasive cloth/paper sheets 7 at the opposite axial ends again come into contact therewith. Thus, the polishing depth in P2 is smaller than the polishing depth (d) in the effective polishing width (be), and the polished surface has a substantially trapezoidal sectional shape as shown in FIG. 7.

Next, the rotating polishing tool 1 according to the present invention will be compared with a conventional rotating polishing tool 12 in which a polishing member 11 includes a plurality of laminated polishing units 9. As an abrasive cloth/paper sheet 7 for constituting polishing members 3 and 11, an abrasive cloth/paper sheet having a mesh base material and roughness of 80 grit (MG#80 produced by Sankyo Rikagagu Co. Ltd.) was used.

First, an appearance of the polishing member 3 in the present invention will be compared with an appearance of the polishing member 11 in the conventional product. The polishing member 11 in the conventional product has a structure including the plurality of laminated polishing units 9, and in a boundary between the polishing units 9, two plates that constitute inner metal fittings 8 overlap to create a clearance between abrasive cloth/paper sheets 7. On the other hand, the polishing member 3 in the present invention includes no inner metal fitting 8 in the intermediate portion 10, and only one plate that constitutes the inner metal fitting 8 is placed in the boundary between the polishing unit 9 and the intermediate portion 10, which creates no clearance between the abrasive cloth/paper sheets 7 and provides a good appearance.

Comparing a ten-point average roughness RZ (the sum of an average value of heights of the highest to fifth highest tops and an average value of depths of the deepest to fifth deepest bottoms, viewed from a line in parallel with an average line), in polishing a polished surface the ten-point average roughness of a polished surface of the conventional product varies between 20 and 35 μm, while the ten-point average roughness of a polished surface of the present invention is stable at 20 μm. This may be because no clearance is created between the abrasive cloth/paper sheets 7 in the present invention, and a distribution density of abrasive grains is substantially even.

Comparing durabilities, in the conventional product, clogging of the abrasive cloth/paper sheet 7 may occur during polishing, while in the present invention, clogging did not occur during polishing until the polishing member 3 wears out radially 5 mm from the peripheral surface of the flange 4. Continuous operating time of the polishing member 11 in the conventional product was 8 to 10 hours, while continuous operating time of the polishing member 3 in the present invention was 20 hours. This may be because no clearance is created between the abrasive cloth/paper sheets 7 in the present invention to increase the distribution density of the abrasive grains.

Next, the effect of an outer diameter of the polishing member 3 in the present invention will be described. The outer diameter of the polishing member 3 was set to ϕ220 (peripheral speed: 2625 m/min), and thus the continuous operating time was increased by three times as compared with the outer diameter of the polishing member 3 set to ϕ200 (peripheral speed: 2386 m/min). This may be because the increase in the peripheral speed increases a polishing property. When the outer diameter of the polishing member 3 is excessively increased, the serpentine width of the abrasive cloth/paper sheet 7 becomes small to easily cause streak-like irregularities.

INDUSTRIAL APPLICABILITY

The rotating polishing tool of the present invention is used for polishing the surface of the steel plate for removing scales on the surface of the steel plate, thereby allowing the polished surface to be finished without any flaw and finished with stable surface roughness suitable for coating on the polished surface. The polishing member has high durability to allow long-hour polishing without changing the polishing member, and is suitable for polishing a polished surface with a large area.

Thus, for example, when a steel plate is bent to form a tank wall of an oil tank, a flaw on a surface of a supplied steel plate is removed as a preprocess to prevent the steel plate from being broken by bending stress in bending.

The invention claimed is:

1. A rotating polishing tool in which a substantially cylindrical polishing member is rotatably supported around a central axis thereof, and said polishing member is rotated to polish a subject to be polished with a peripheral surface thereof, wherein said polishing member includes a pair of polishing units at axial opposite ends of said central axis, and an intermediate portion provided between said pair of polishing units, wherein each of said polishing units includes a plurality of laminated substantially circular abrasive cloth/paper sheets each having a shaft insertion opening in the center, said plurality of abrasive cloth/paper sheets are pressingly held by a ring-shaped inner metal fitting inserted through the shaft insertion openings, and said inner metal fitting is formed into a serpentine shape that curves up and down in the axial direction of said central axis to form peripheral edges of the abrasive cloth/paper sheets into a serpentine shape, wherein flanges that pressingly hold said polishing member are placed on opposite outer sides of said polishing units along said central axis, and inner side surfaces of said flanges along said central axis are formed into a serpentine shape corresponding to the serpentine shape of said inner metal fitting, wherein said intermediate portion includes a plurality of abrasive cloth/paper sheets different from the abrasive cloth/paper sheets constituting said polishing units, said abrasive cloth/paper sheets of said intermediate portion being flat abrasive/cloth paper sheets, laminated without any clearance along said central axis, and wherein said abrasive cloth/paper sheets of said intermediate portion are pressingly held along said central axis by said pair of polishing units, and thus the peripheral edges of said abrasive cloth/paper sheets of said intermediate portion are formed into a serpentine shape.

2. The rotating polishing tool according to claim 1, wherein said inner metal fitting is partially pressed along said central axis with said plurality of abrasive cloth/paper sheets being pressingly held, and thus bent into a serpentine shape that curves in the axial direction of said central axis.

3. The rotating polishing tool according to claim 1, wherein each of said abrasive cloth/paper sheets is a mesh sheet coated with abrasive grains.

4. The rotating polishing tool according to claim 1, wherein the peripheral edges of said abrasive cloth/paper sheets of said intermediate portion are formed so as for a developed shape thereof to be a substantially S-shaped curve.

* * * * *